US007186994B1

(12) United States Patent
Spruce

(10) Patent No.: US 7,186,994 B1
(45) Date of Patent: Mar. 6, 2007

(54) CONTAINER FOR TRANSPORT OF HAZARDOUS MATERIALS

(75) Inventor: David M. Spruce, Lakewood, CO (US)

(73) Assignee: The S.M. Stoller Corporation, Lafayette, CO (US)

( * ) Notice: Subject to any disclaimer, the term of this patent is extended or adjusted under 35 U.S.C. 154(b) by 141 days.

(21) Appl. No.: 10/943,286

(22) Filed: Sep. 17, 2004

Related U.S. Application Data

(60) Provisional application No. 60/504,779, filed on Sep. 17, 2003.

(51) Int. Cl.
*G21F 5/015* (2006.01)
*G21F 5/08* (2006.01)

(52) U.S. Cl. ..... 250/507.1

(58) Field of Classification Search ..... None
See application file for complete search history.

(56) References Cited

U.S. PATENT DOCUMENTS 3,369,121 A * 2/1968 Bruno et al. ..... 250/506.1
4,560,069 A * 12/1985 Simon ..... 250/506.1
5,024,865 A * 6/1991 Insley ..... 428/36.4
6,586,758 B2 * 7/2003 Martin ..... 250/507.1

OTHER PUBLICATIONS

Material presented to Canberra User Group, Jun. 2004, Boston, Massachusetts (2 pgs).
"New rad sample package flight worthy," Rocky Flats Endvision, pp. 1 and 5, vol. 10, No. 6, Mar. 25, 2004 (2 pgs).
"New radioactive sample package meets flight requirements," S.M. Stoller Corporation Employee Newsletter, May/Jun. 2004, p. 2 (1 pg).

* cited by examiner

*Primary Examiner*—Jack I. Berman
(74) *Attorney, Agent, or Firm*—Faegre & Benson LLP

(57) ABSTRACT

Apparatus and methods for shipping hazardous materials, such as radioactive liquids and materials, that comply with certain international and national regulations for the transport of hazardous materials. According to one embodiment, hazardous material samples are placed inside inner containers, such as glass bottles. Inner containers are placed inside secondary containers, surrounded and cushioned by high density polyethylene ("HDPE") foam inserts. Secondary containers are placed inside cutouts in a HDPE custom insert. Custom insert is inside an outer container made with HDPE and held together with extruded aluminum hardware, closed-end aluminum and steel rivets, and a sealant applied to the seams.

20 Claims, 20 Drawing Sheets

SECONDARY CONTAINER LID
TAPING CONFIGURATION

SINGLE STACK CONFIGURATIONS

1" LITER

500 ML (3) 60 ML

DOUBLE STACK CONFIGURATIONS (3) 40 ML + (3) 40 ML (3) 40 ML + (3) 20 ML

DOUBLE STACK CONFIGURATIONS (3) 60 ml + 125 ML (3) 60 ml + (3) 40 ML (3) 60 ml + (3) 20 ML

DOUBLE STACK CONFIGURATIONS

125 ML + 125 ML

125 ML + (3) 40 ML

125 ML + (3) 20 ML

DOUBLE STACK CONFIGURATIONS
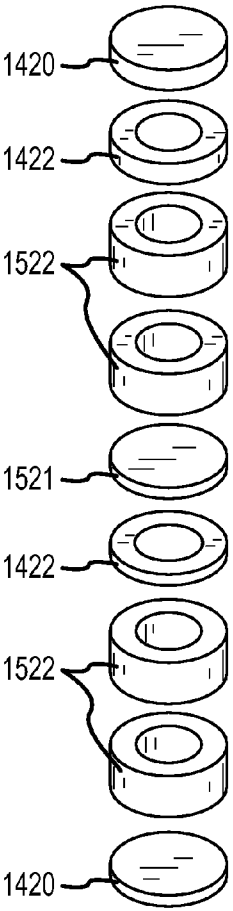
250 ML + 250 ML
FIG.15I
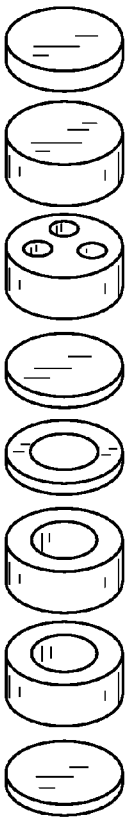
250 ML + 125 ML
FIG.15J
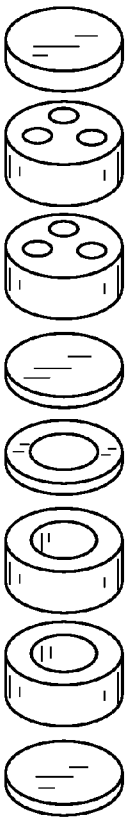
250 ML + (3) 40 ML
FIG.15K
250 ML + (3) 20 ML
FIG.15L

DOUBLE STACK CONFIGURATIONS

500 ML + 125 ML

500 ML + (3) 40 ML

500 ML + (3) 20 ML

TRIPLE STACK CONFIGURATIONS

250 ML + (3) 20 ML + (3) 20 ML

125 ML + (3) 20 ML + (3) 20 ML (3) 40 ML + (3) 20 ML + (3) 20 ML (3) 20 ML + (3) 20 ML + (3) 20 ML

CONTINUOUS HINGES

VALANCE SPANNING CATCH

FOUR-HOLE CLAMP
WITH RIVET PROTECTORS

COMBINATION
CORNER AND CLAMP

LARGE RECESSED HANDLE

FLAT CORNER

CONTAINER FOR TRANSPORT OF HAZARDOUS MATERIALS

CROSS-REFERENCE TO RELATED APPLICATION

This application claims the benefit of U.S. Provisional Application Ser. No. 60/504,779, filed Sep. 17, 2003, the contents of which are incorporated herein by reference.

COPYRIGHT NOTICE

Contained herein is material that is subject to copyright protection. The copyright owner has no objection to the facsimile reproduction of the patent disclosure by any person as it appears in the Patent and Trademark Office patent files or records, but otherwise reserves all rights to the copyright whatsoever. Copyright© 2004 S. M. Stoller Corporation.

BACKGROUND

Embodiments of the present invention relate generally to packaging to ship hazardous materials. More particularly, embodiments of the present invention relate to packaging to ship radioactive material and radioactive liquids.

In the field of hazardous material transport, the packaging used for transport must comply with strict international and national regulations. For instance, a Department of Transportation ("DOT") 7A Type A package must be used to ship radioactive liquids. Such shipped packages must comply with the DOT regulations for Hazardous Materials, of which 49 C.F.R. §§ 100–178 are herein incorporated by reference. Packages used for transport of hazardous materials by plane must comply with the International Air Transport Association ("IATA") Dangerous Goods Regulations ("DGR"), of which Sections 5, 6, and 10 are herein incorporated by reference. Consequently, a packaging design was necessary that complied with both sets of hazardous material transport regulations.

The only currently available packaging qualified to ship radioactive liquids up to an $A_2$ quantity is known as a "bean pot," and will only hold one liter of liquid. The shipping costs to ship large quantities of samples needing analysis, one sample bottle at a time, can be prohibitive. Additionally, many samples can be taken in very radioactively contaminated environments, and/or need to be analyzed for organic content, so they must be sealed at the time of capture to preserve all of the constituents for accurate analysis. Consequently, a new packaging design was necessary that would accommodate shipping multiple sample containers in one packaging.

Often, the samples needing analysis contain multiple hazardous materials from more than one hazard class. This necessitates that the package being used meet the requirements for all hazards being shipped. For example, the IATA DGR and DOT regulations for the transport of radioactive materials require the packaging to withstand various tests, including: a water spray test, a free drop test, a stacking test, an internal pressure test, and a penetration test.

SUMMARY

Apparatus and methods are described for shipping hazardous materials, such as radioactive materials and radioactive liquids.

According to one embodiment, the package design meets International Air Transport Association (IATA) Dangerous Goods Regulations (DGR) and/or Department of Transportation (DOT) regulations for Hazardous Materials (49 C.F.R. §§ 100–178) for multiple and preferably all hazard classes as a Packing Group I package, and a 7A Type A package for radioactive material, including radioactive liquids. According to another embodiment, the package design accommodates shipping a plurality of sample containers in one packaging and provides flexibility in terms of the mixing and matching of various sized sample containers.

According to one embodiment, the container used for transport has several components. The container is a box with a foam insert with cutouts for six secondary container cylinders, and seven slots for holding ice packs. Hazardous materials such as radioactive liquids and/or solids are placed into a glass bottle. The lid of the glass bottle is then closed. The glass bottle is double contained in plastic and secured with plastic tape. The glass bottle is then inserted into a secondary container, along with layers of foam inserts separating the glass bottle from the inside of the secondary container and from other glass bottles within the secondary container. The lid of the cylindrical secondary container is then closed, and the lid is secured with plastic tape. The secondary container is inserted into one of the six cutouts in the box. Then the lid for the box is closed and secured. The package is then ready for shipping.

Other features of embodiments of the present invention will be apparent from the accompanying drawings and from the detailed description that follows.

BRIEF DESCRIPTION OF THE DRAWINGS

Embodiments of the present invention are illustrated by way of example, and not by way of limitation, in the figures of the accompanying drawings and in which like reference numerals refer to similar elements and in which.

DETAILED DESCRIPTION

Figure 1:
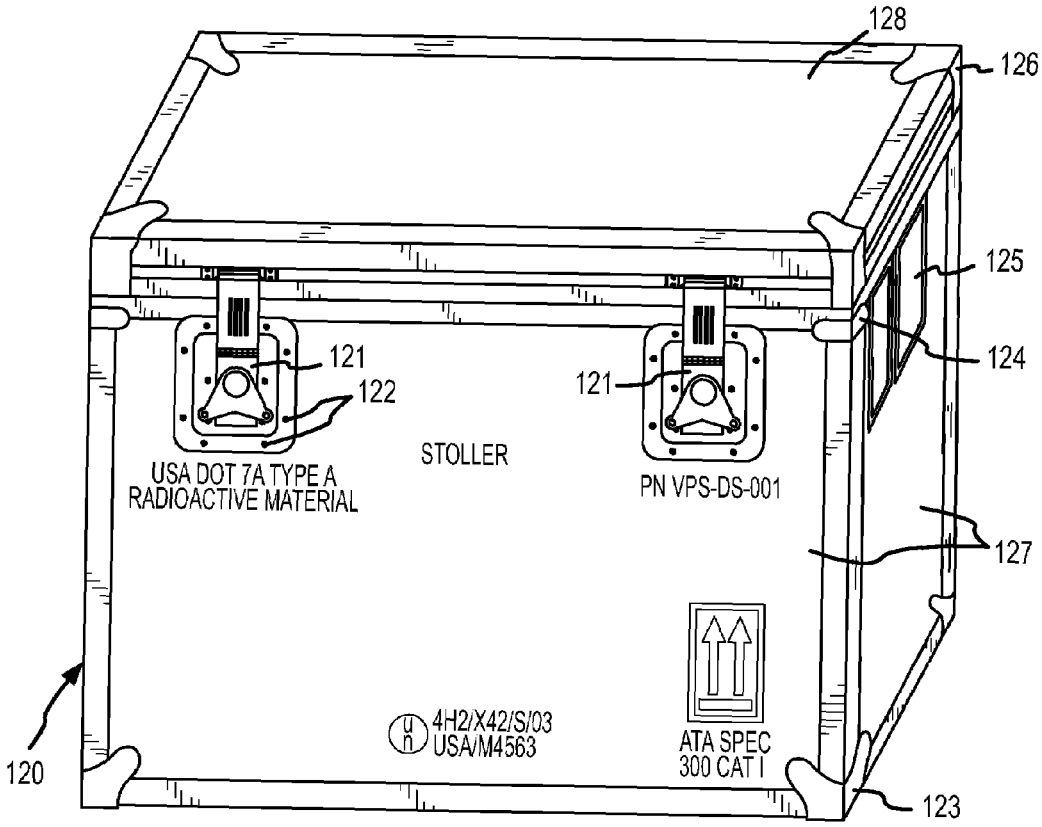
FIGS. 1–3 depict various views of a container according to one embodiment of the present invention.
Figure 3:
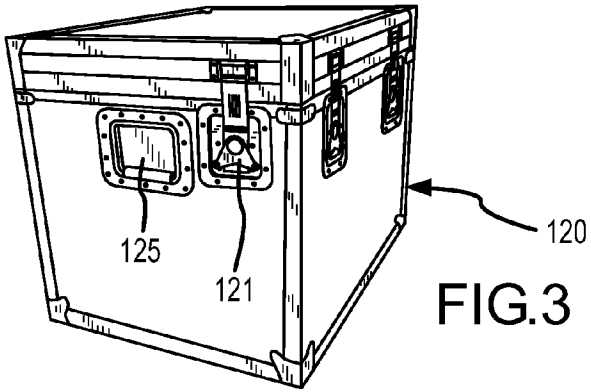
Figure 5:
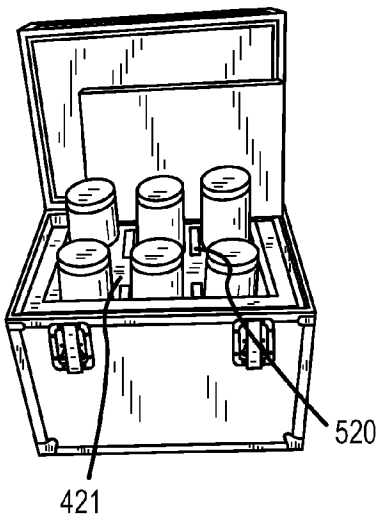
FIGS. 4–5 depict an internal packaging configuration according to one embodiment of the present invention.
Figure 2:
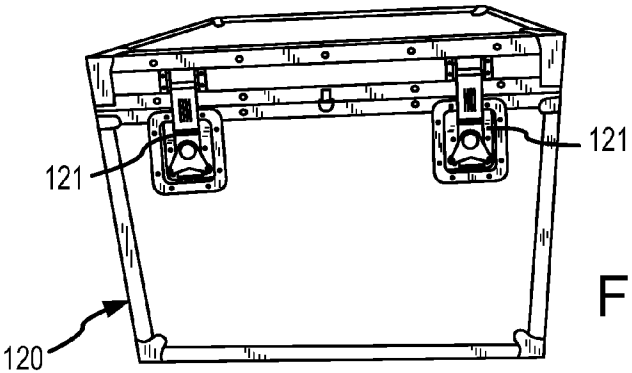
Figure 4:
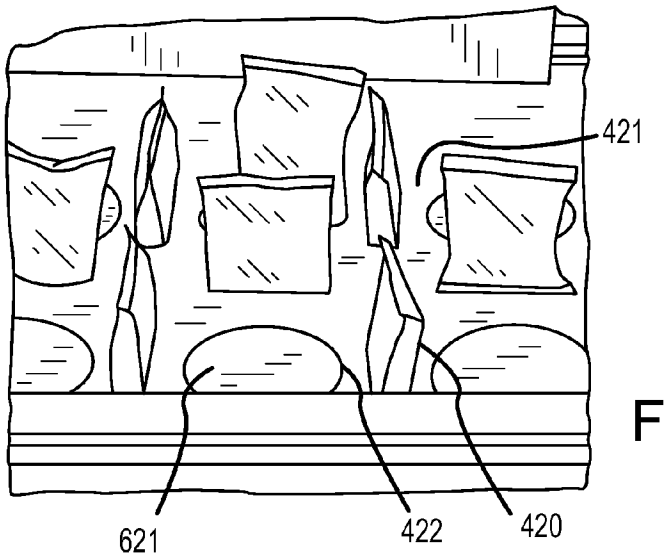

Apparatus and methods are described for shipping hazardous materials, such as radioactive materials and radioactive liquids.

According to one embodiment, the package design meets International Air Transport Association (IATA) Dangerous Goods Regulations (DGR) and/or Department of Transportation (DOT) regulations for Hazardous Materials (49 C.F.R. §§ 100–178) for all hazard classes as a Packing Group I package, and a 7A Type A package for radioactive material, including radioactive liquids. According to another embodiment, the package design accommodates shipping a plurality of sample containers in one packaging and provides flexibility in terms of the mixing and matching of various sized sample containers.

For the purposes of explanation, specific details regarding particular commercial embodiments are set forth herein in order to provide a thorough understanding of various aspects of the present invention. It will be apparent, however, to one skilled in the art that embodiments of the present invention may be practiced without some of these specific details.

While, for convenience, embodiments of the present invention are described with reference to particular commercial embodiments formed of particular materials, parts, hardware, sealants, foams, sample container configurations, embodiments of the present invention are equally applicable to various other industry-recognized equivalents and alternative configurations.

Further information regarding specific embodiments of the present invention are described below. It will, however, be evident that various modifications and changes may be made thereto without departing from the broader spirit and scope of the invention. The specification and drawings are, accordingly, to be regarded in an illustrative rather than a restrictive sense. Further, like reference numbers are used to refer to the same element throughout all drawing figures.

A particular configuration chosen to satisfy 49 C.F.R. §§ 173.201 and 173.211, along with IATA DGR for UN Specification Packaging, is a solid plastic outer container 120 containing glass inner containers 720. This configuration may also meet the requirements for a Type A package as defined in 49 C.F.R. § 173.412. The outer packaging may be manufactured by Viking Packing Specialist. The glass inner containers 720 may be obtained from Eagle Picher.

Looking first to FIGS. 1–5, the outer wall 127 of the outer container 120 is a 3/16 inch thick high density polyethylene ("HDPE") material. The outer wall 127 is held together with extruded aluminum hardware and closed-end aluminum and steel rivets 122, with Hybraflex sealant applied to seal the seams. Bonded to the outer wall is a ½ inch thick layer of 1.7# density HDPE open cell foam. Bonded to the layer of open cell foam is a ½ inch thick cloth-covered 1.7# HDPE foam pad with Formflex HDPE backing.

Figure 17A:
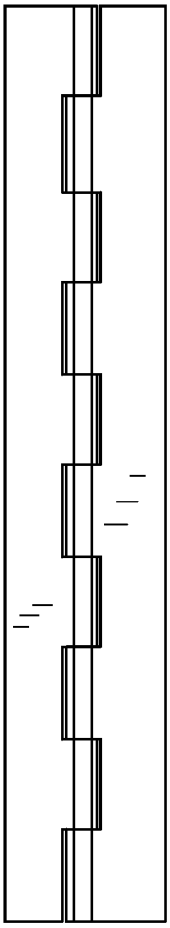
FIGS. 17A–C illustrate various continuous hinges that may be employed in the container design according to one embodiment of the present invention.
Figure 17B:
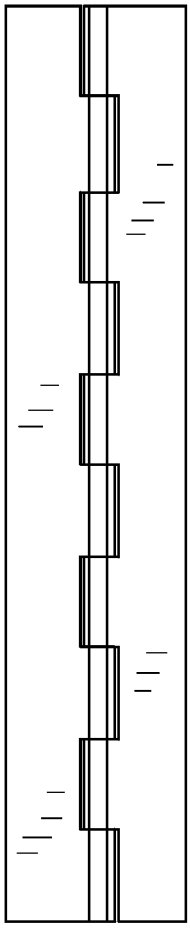
Figure 17C:
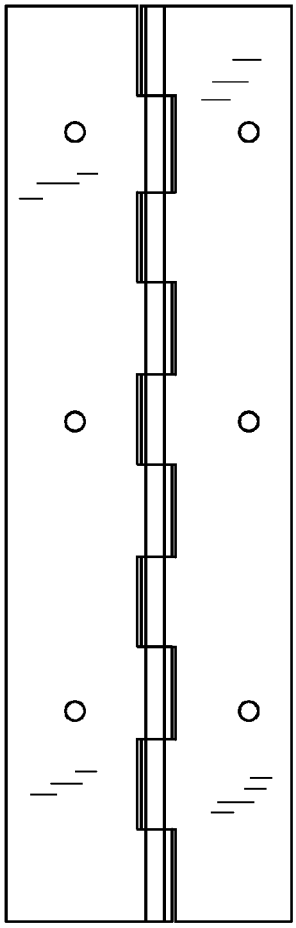
Figure 18:
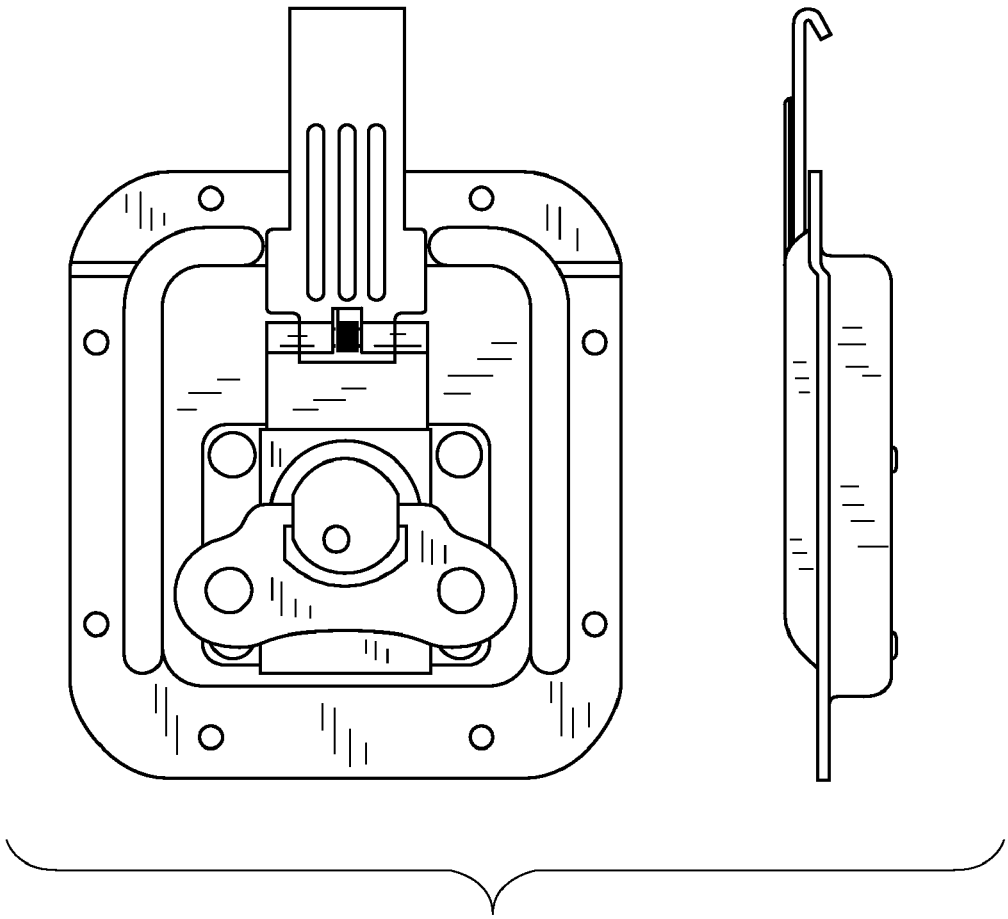
FIG. 18 illustrates a valance spanning catch that may be employed in the container design according to one embodiment of the present invention.
Figure 19:
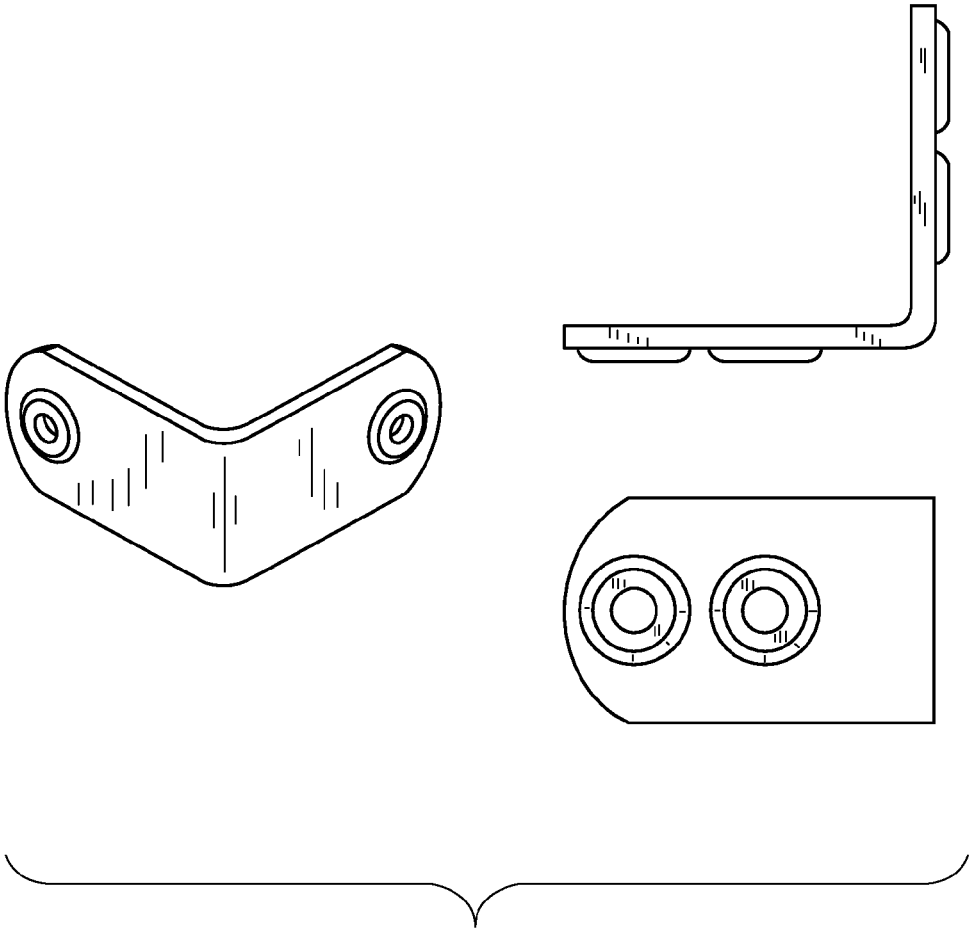
FIG. 19 illustrates a four-hole clamp that may be employed in the container design according to one embodiment of the present invention.
Figure 20:
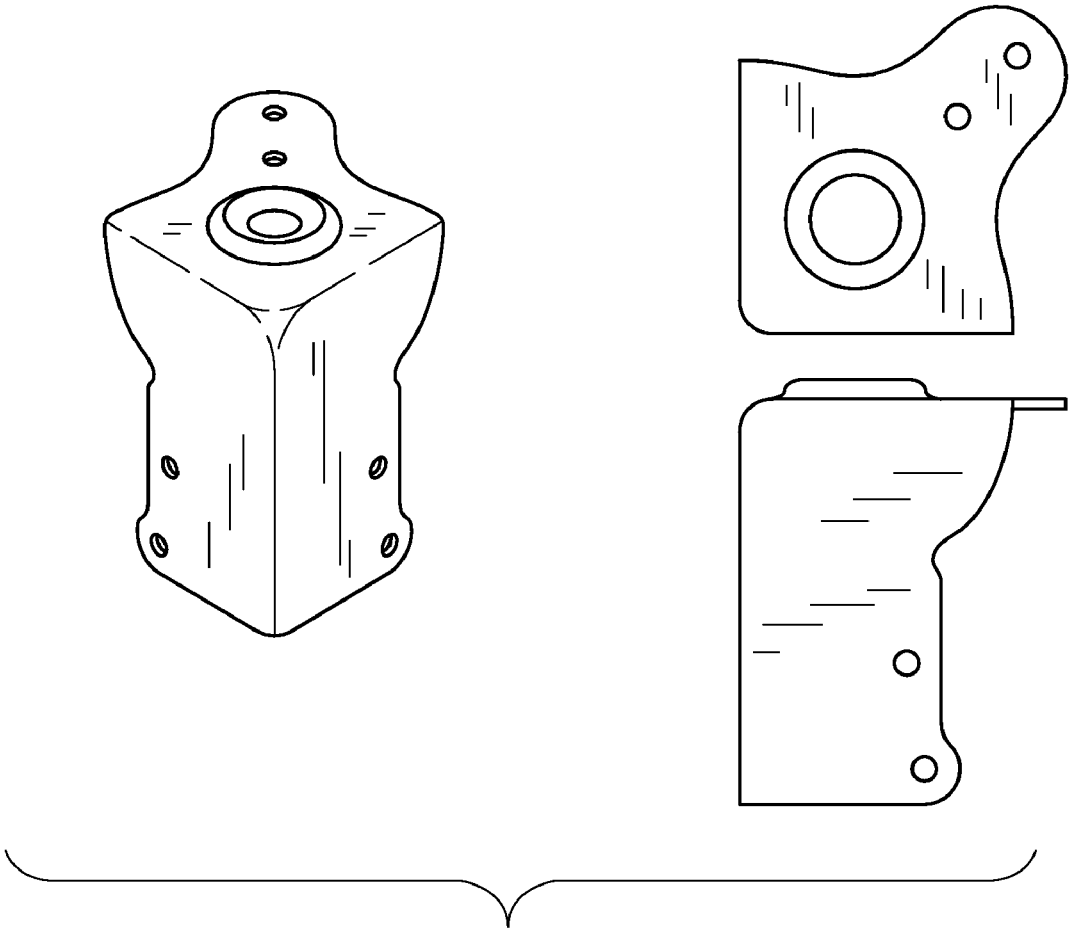
FIG. 20 illustrates a combination corner and clamp that may be employed in the container design according to one embodiment of the present invention.
Figure 21:
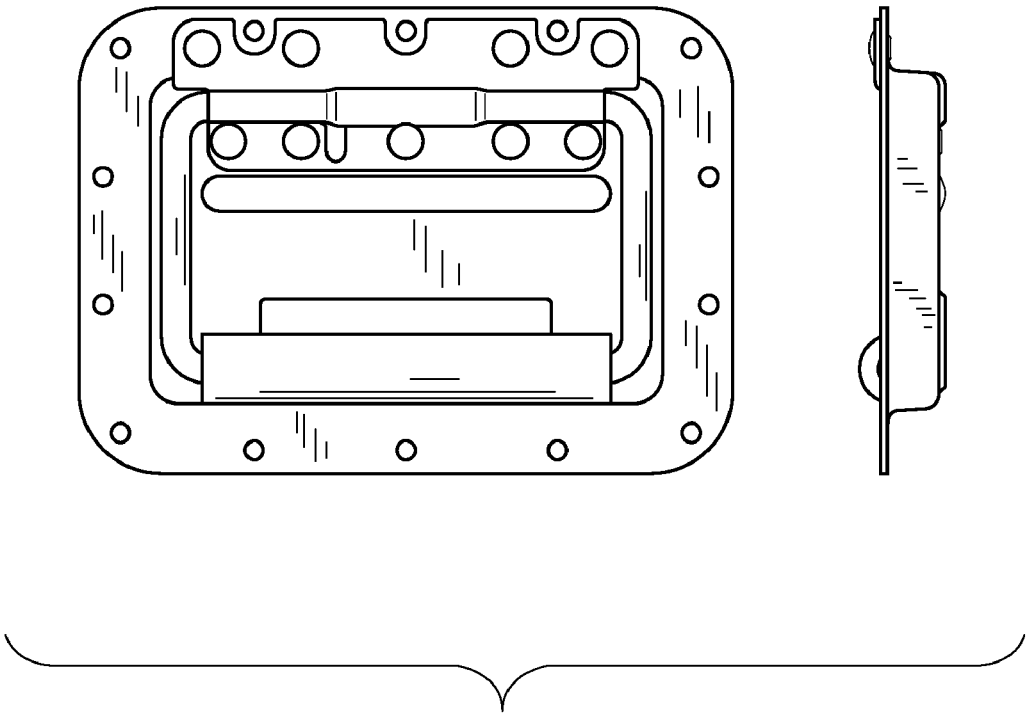
FIG. 21 illustrates a large recessed handle that may be employed in the container design according to one embodiment of the present invention.
Figure 22:
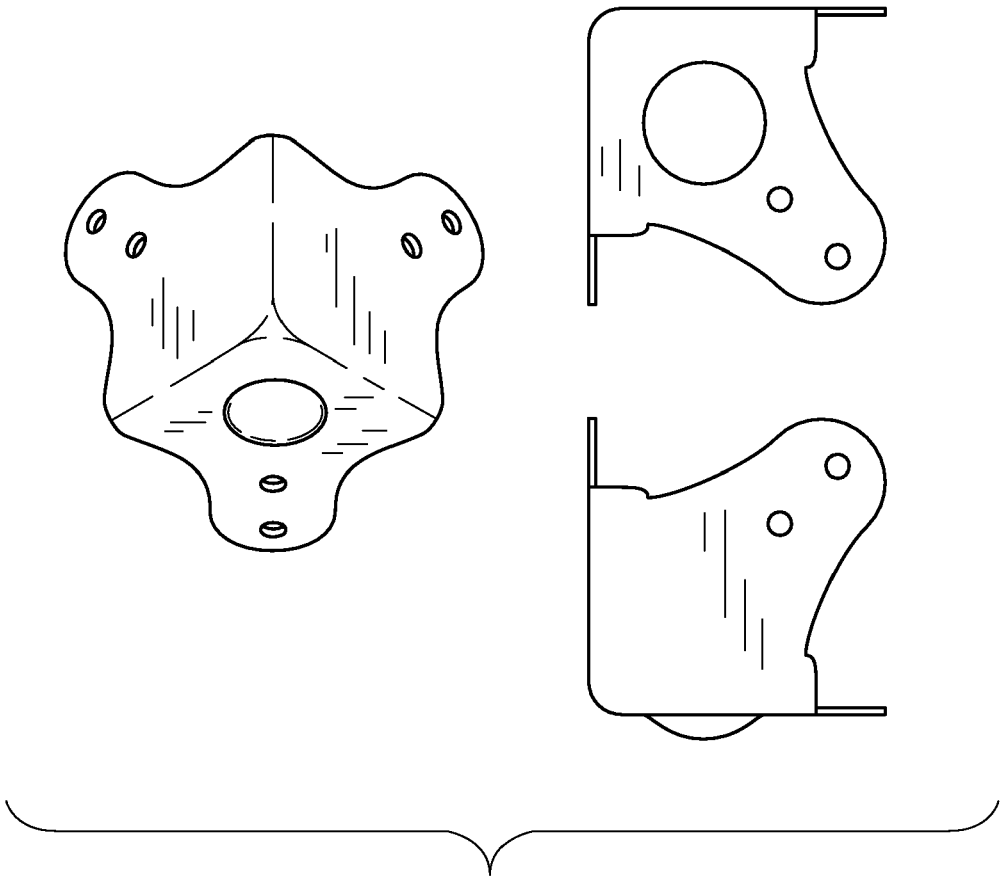
FIG. 22 illustrates a flat corner with stacking foot that may be employed in the container design according to one embodiment of the present invention.

The extruded aluminum hardware includes several different elements. The lid 128 of the outer container 120 is attached with a full-length piano hinge (depicted in FIGS. 17A–C). The lid 128 is latched closed by four valance spanning latches 121, two on the front and one on each side of the outer container 120. There is a recessed handle 125 on each end of the outer container 120 for handling the outer container 120, and D-rings on the outer container 120 and lid 128 on the front side for applying sealing and tamper indicating devices. Four-hole clamps 124, also depicted in FIG. 19, hold together the outer walls 127 of the outer container 120. Combination corner-clamps 126, also depicted in FIG. 20, are attached to the top corners of the lid 128. Flat corners 123, also depicted in FIG. 22, are attached to the bottom corners of the outer container 120. One embodiment of the outer container 120 has outside dimensions of 28.25 inches wide, 18.375 inches high, and 18.375 inches deep.

Figure 6:
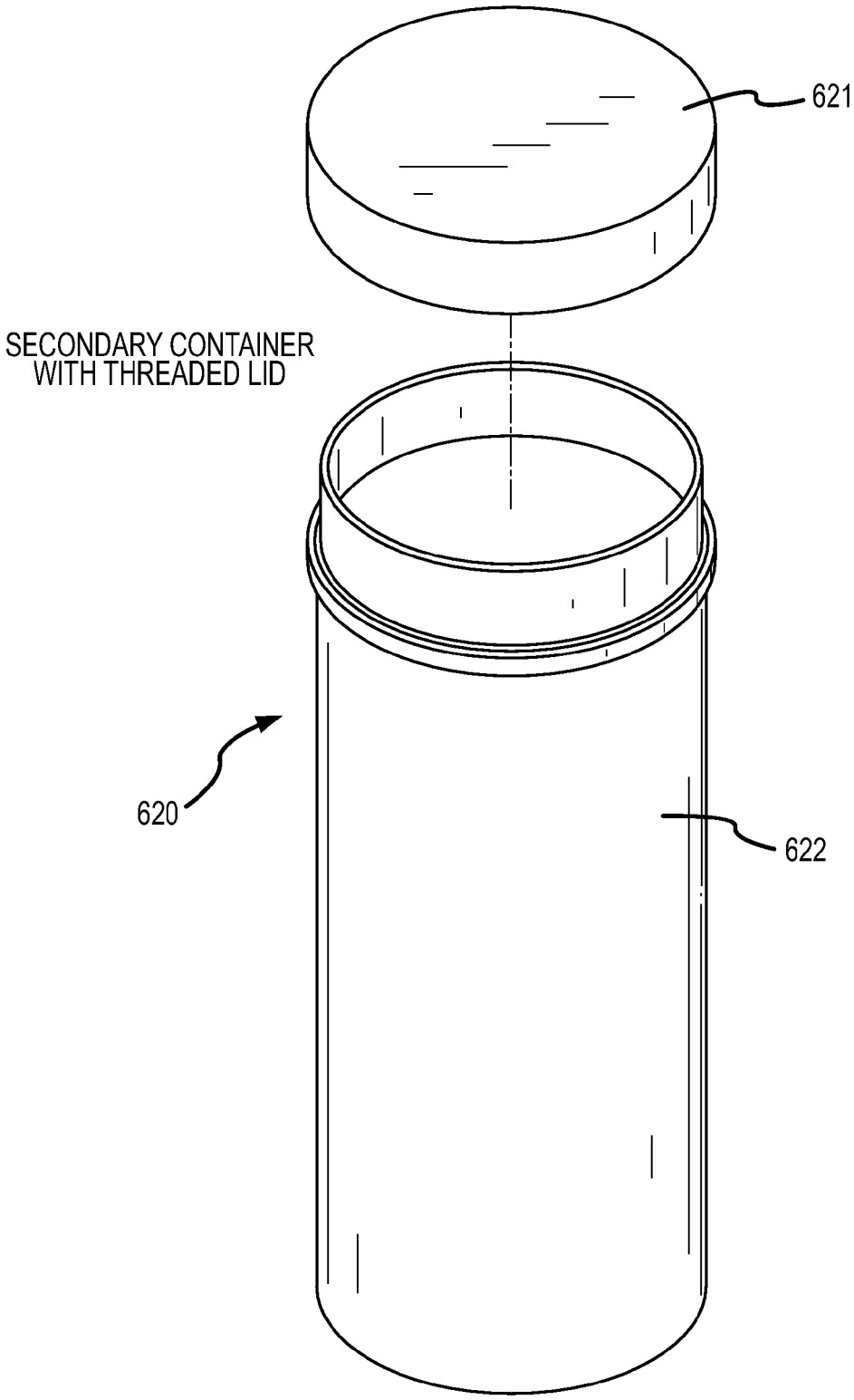
FIG. 6 depicts a secondary container according to one embodiment of the present invention.

Inside the outer container 120 is a custom insert 421 made of the 1.7# density HDPE open cell foam. The custom insert 421 features six cylindrical cutouts 422, and seven slots 520 for retaining ice packs. Depending upon the number and size of sample containers that need to be accommodated, more or fewer cylindrical cutouts 422 may be employed. Further, depending on the cooling needs, more or fewer slots 520 may be present. Inside each cutout 422 fits a secondary container 620. As seen in FIG. 6, the secondary container 620 has a threaded lid 621 and a cup portion 622. In one embodiment, the secondary container 620 has a diameter of five inches and a height of twelve inches.

Figure 10:
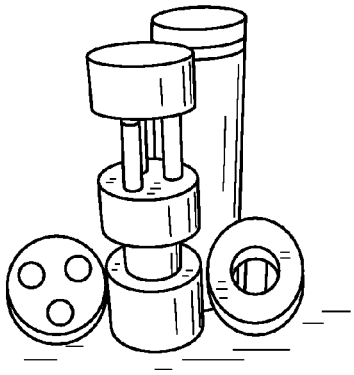
FIGS. 10–13 depict various foam inserts and secondary containers according to one embodiment of the present invention.
Figure 11:
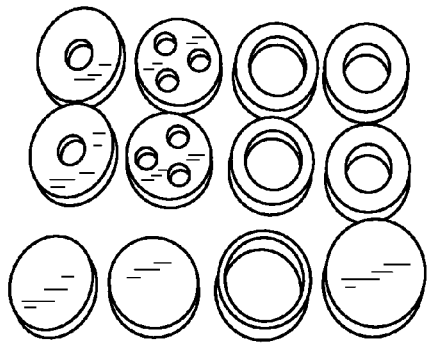
Figure 12:
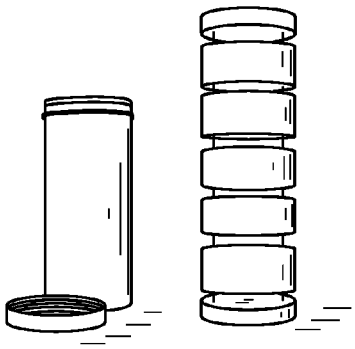
Figure 13:
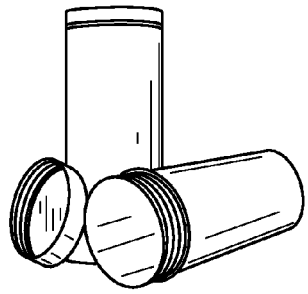

Referring now to FIGS. 7–16, the inner containers 720, also seen in FIGS. 10 and 12, are amber glass, and are commonly available in seven sizes, as tested: 20 mL, 40 mL, and 60 mL vials with Teflon® septa; and 125 mL, 250 mL, 500 mL, and 1 L wide mouth bottles with solid plastic lids. All seven sizes have been tested within the context of the preferred embodiment and meet the 95 kPa internal pressure test prescribed by 49 C.F.R. § 173.27(c), and Section 5.0.2.9 of the IATA Dangerous Goods Regulations.

The inner containers 720 are placed into the secondary containers 620 along with various foam inserts, as seen in FIGS. 7, 8, and 10–16. These foam inserts are of different shapes and sizes. Also constructed of 1.7# HDPE open cell foam, the foam inserts provide cushioning for the various sized inner containers 720. The foam inserts provide cushioning for the inner containers 720 by filling the space between the inner containers 720 and the inside of the secondary container 620. This is accomplished by stacking layers of different foam inserts, wherein each foam insert is customized to conform to and fit around inner containers 720 of a certain size.

Figure 14A:
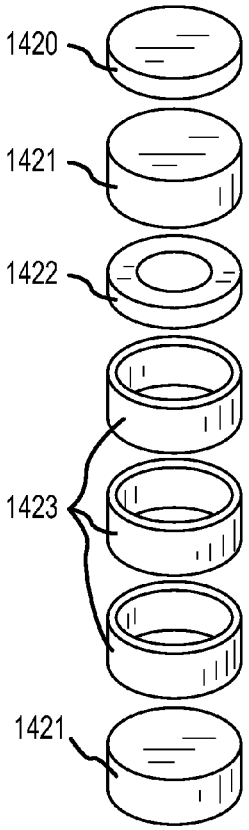
FIGS. 14A–C illustrate various single stack packaging configurations within a secondary container according to one embodiment of the present invention.
Figure 14B:
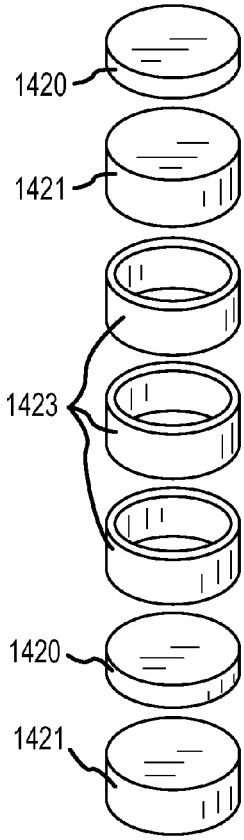
Figure 14C:
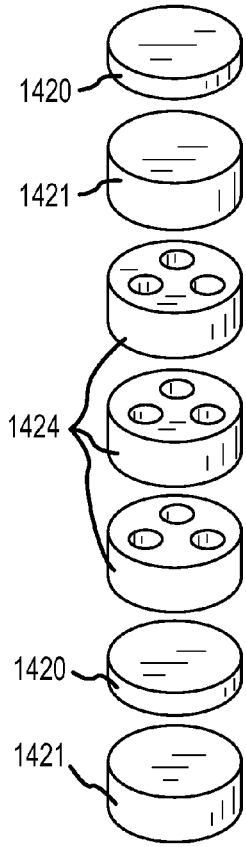
Figure 15A:
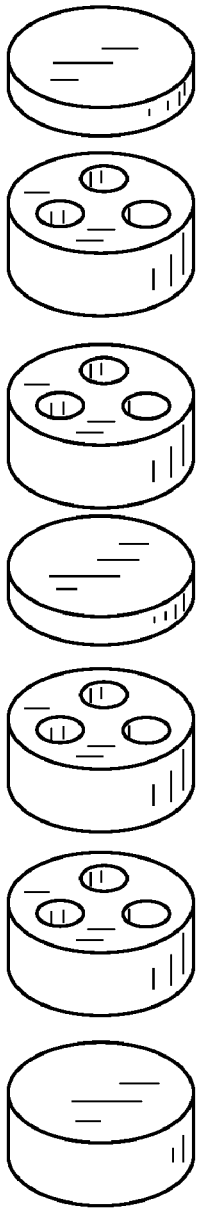
FIGS. 15A–O illustrate various double stack packaging configurations within a secondary container according to one embodiment of the present invention.
Figure 15B:
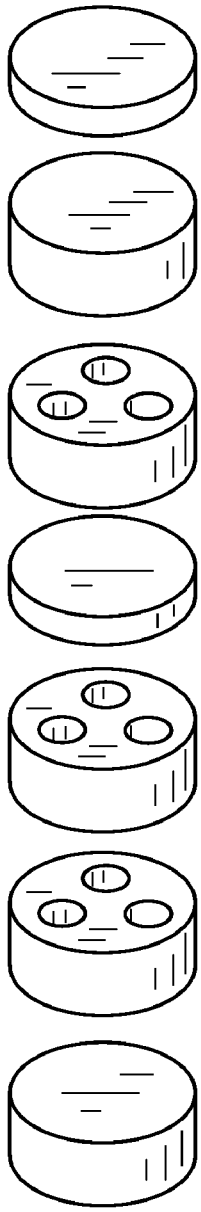
Figure 15C:
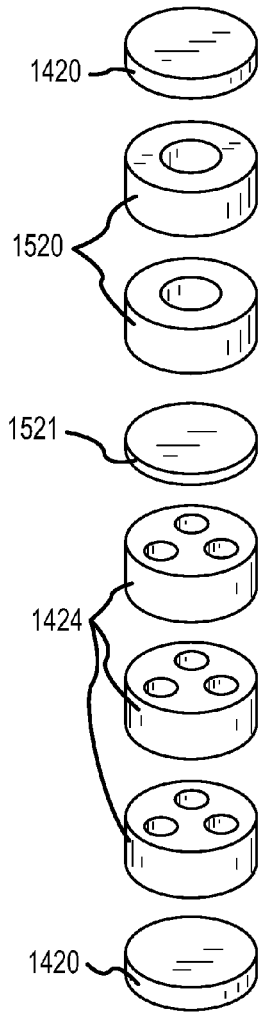
Figure 15D:
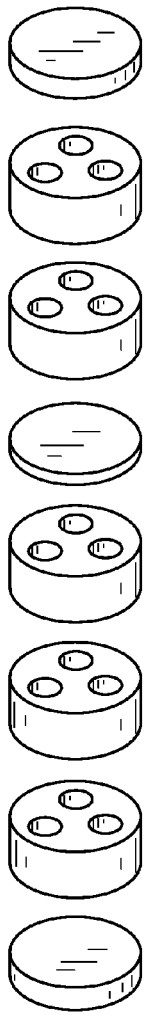
Figure 15E:
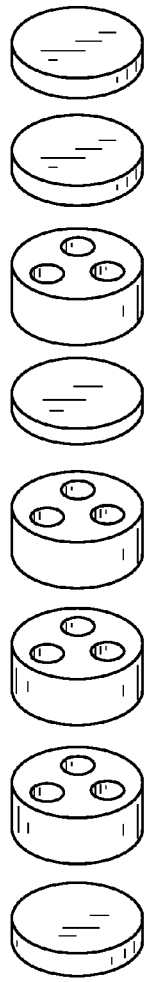
Figure 15F:
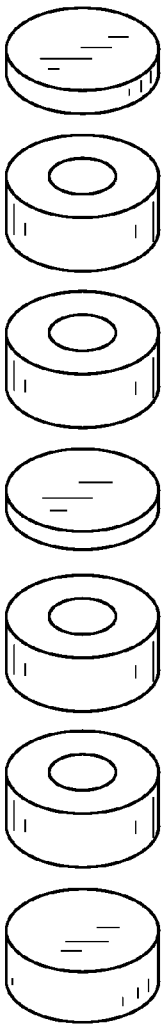
Figure 15G:
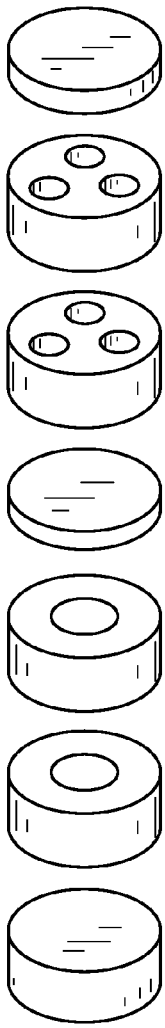
Figure 15H:
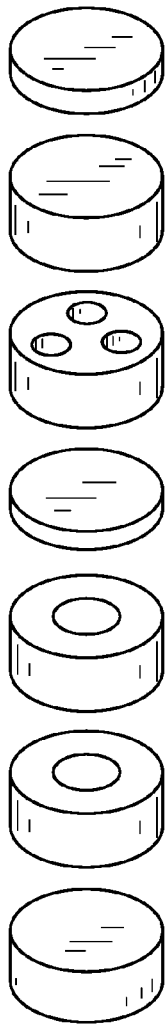
Figure 15M:
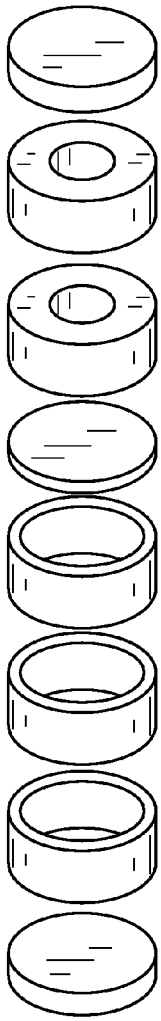
Figure 15N:
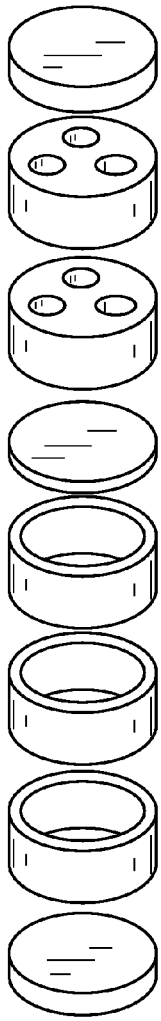
Figure 15O:
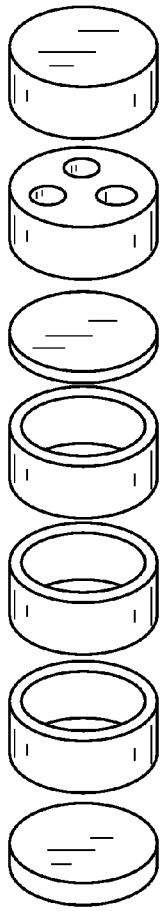

Inner containers 720 may be stacked with the foam inserts inside secondary containers 620 to allow one to three stacks of inner containers 720 separated by foam inserts. Without limitation, some various configurations for single, double, and triple-stacked inner containers 720 are depicted in FIGS. 14–16. According to the embodiment depicted, the foam inserts all have an outer diameter that conforms to the inner diameter of the secondary container 620. As seen in FIGS. 14A–C, different variations of the foam inserts may include: a one-inch tall cylindrical foam insert 1420, a taller cylindrical foam insert 1421, a hollow foam insert 1422 with an inner diameter that conforms to the top of a 1 L inner container 720, and a hollow foam insert 1423 that conforms to the outer diameter of the bottom portion of a 1 L inner container 720. Foam insert 1424 features three longitudinal, non-overlapping cylindrical holes wherein the diameter of each of the holes conforms to the outer diameter of a 60 mL, 40 mL, or 20 mL inner container 720. FIGS. 15A–C depicts a foam insert 1521 with a height smaller than one inch. Foam insert 1520 has an inner diameter that conforms to the outer diameter of a 125 mL inner container 720. Foam insert 1522 has an inner diameter that conforms to the outer diameter of a 250 mL inner container 720.

Figure 16A:
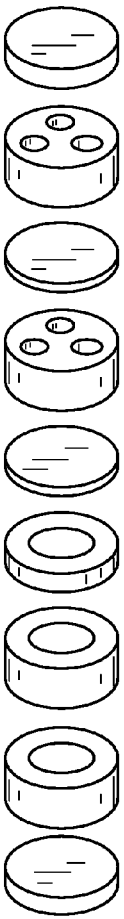
FIGS. 16A–D illustrate various triple stack packaging configurations within a secondary container according to one embodiment of the present invention.
Figure 16B:
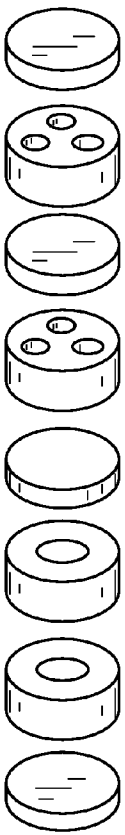
Figure 16C:
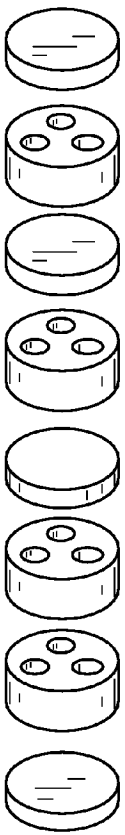
Figure 16D:
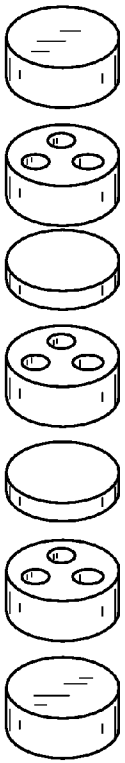

Using and stacking the various foam inserts 1420, 1421, 1422, 1423, 1424, 1520, 1521, and 1522 as depicted in FIGS. 14–16, the following combinations of inner containers 720 will each fit within foam inserts in a single secondary container 620:

one 1 L bottle (FIG. 14A)
one 500 mL bottle (FIG. 14B)
three 60 mL bottles (FIG. 14C)
six 40 mL bottles (FIG. 15A)
three 40 mL and three 20 mL bottles (FIG. 15B)
three 60 mL and one 125 mL bottle (FIG. 15C)
three 60 mL and three 40 mL bottles (FIG. 15D)
three 60 mL and three 20 mL bottles (FIG. 15E)
two 125 mL bottles (FIG. 15F)
one 125 mL and three 40 mL bottles (FIG. 15G)
one 125 mL and three 20 mL bottles (FIG. 15H)
two 250 mL bottles (FIG. 15I)
one 250 mL and one 125 mL bottle (FIG. 15J)
one 250 mL and three 40 mL bottles (FIG. 15K)
one 250 mL and three 20 mL bottles (FIG. 15L)
one 500 mL and one 125 mL bottle (FIG. 15M)
one 500 mL and three 40 mL bottles (FIG. 15N)
one 500 mL and three 20 mL bottles (FIG. 15O)
one 250 mL and six 20 mL bottles (FIG. 16A)
one 125 mL and six 20 mL bottles (FIG. 16B)
three 40 mL and six 20 mL bottles (FIG. 16C)
nine 20 mL bottles (FIG. 16D)

As seen in FIGS. 7, 8, and 10–13, the inner containers 720 remain separated from each other and from the inside of the secondary container 620 due to the foam inserts. The foam insert configurations depicted in FIGS. 14–16 do not comprise an exhaustive depiction of the foam insert embodiments according to the present invention. Those skilled in the art will appreciate that virtually any shape or number of foam inserts may be used to fit bottles or inner containers 720 of various sizes. Additionally, various other shapes of secondary containers 620 may be used, including, but not limited to: square and rectangular. In additional to HDPE foam, any other suitable cushioning material may be used to make the inserts. Also, the outer container 120 may be constructed of other rigid materials, such as metal or wood or other plastics, such that the outer container 120 complies with international and national regulations for the shipping of hazardous materials. The sides of the outer container 120 may be joined using fasteners and hinges made of different materials, or fasteners and hinges of different kinds, than the extruded aluminum elements of FIGS. 17–22.

Figure 7:
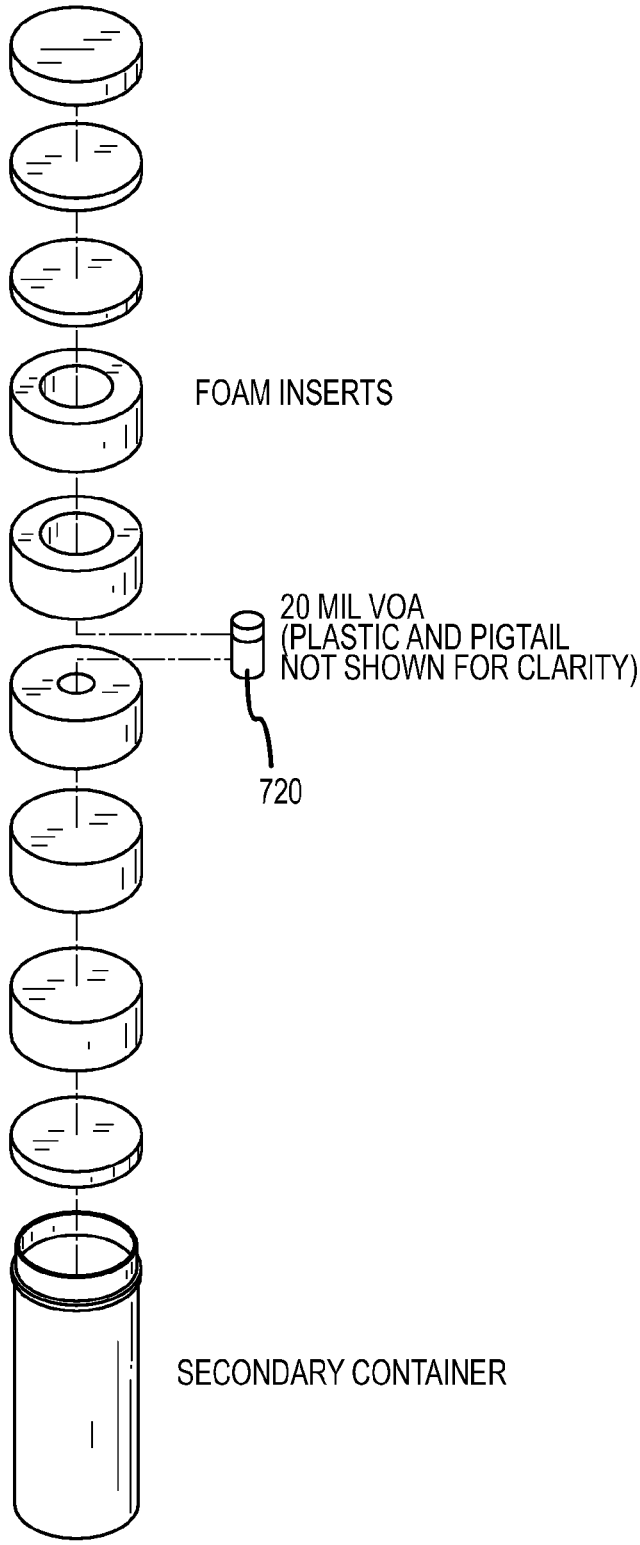
FIG. 7 is an exploded view of a packaging configuration for a 20 mil VOA bottle according to one embodiment of the present invention.
Figure 8:
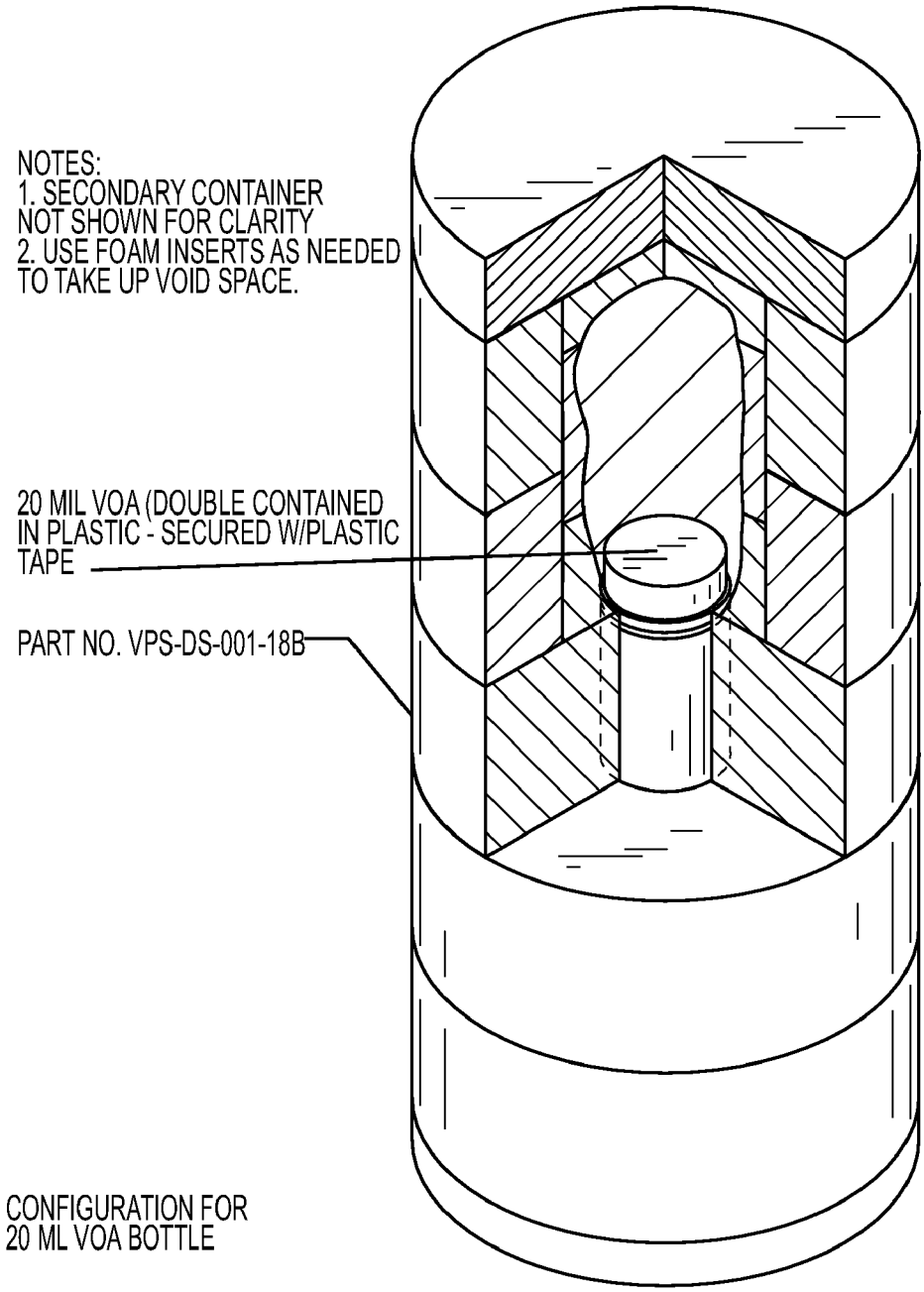
FIG. 8 illustrates a packaging configuration for a 20 mil VOA bottle according to one embodiment of the present invention.
Figure 9:
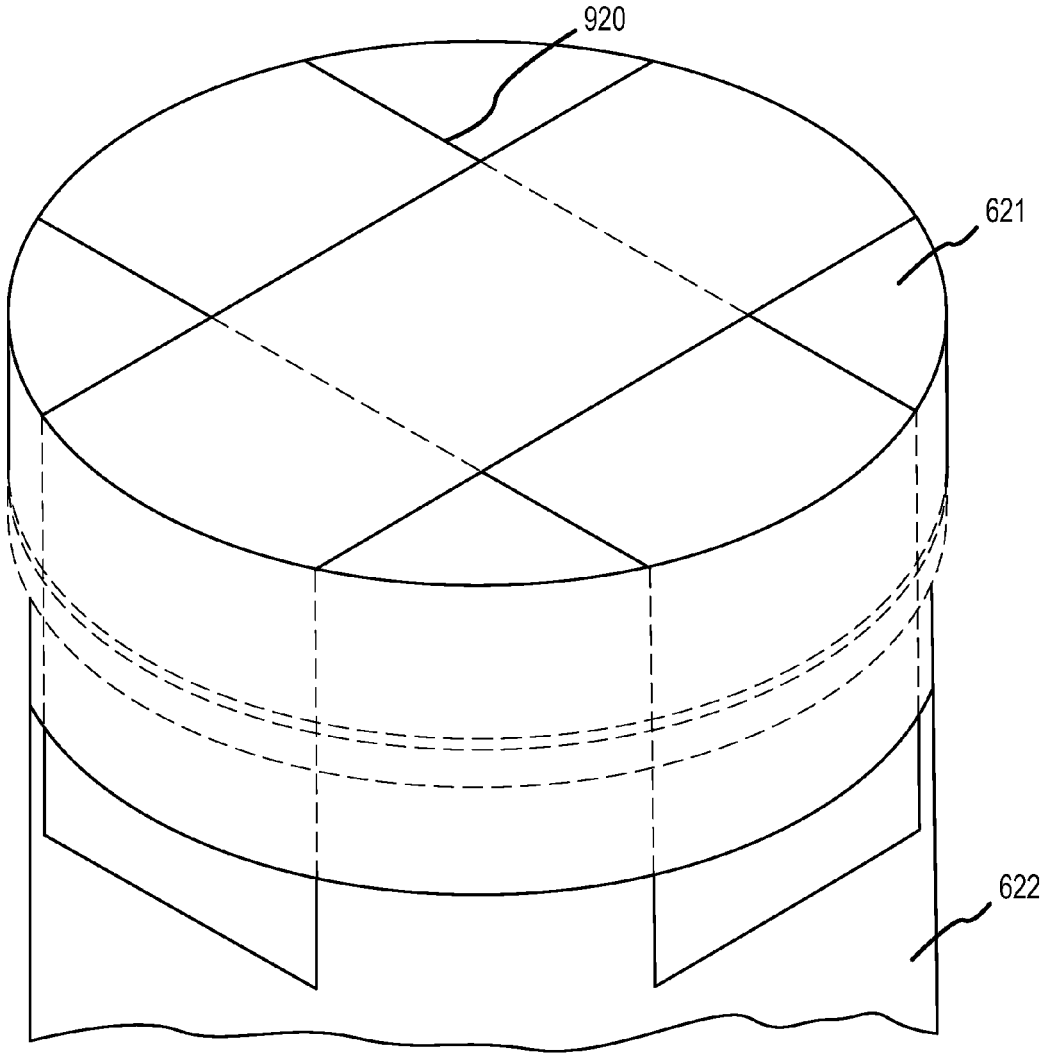
FIG. 9 illustrates a taping configuration for a secondary container lid according to one embodiment of the present invention.

To prepare a sample of radioactive or hazardous material for shipment in one embodiment of the present invention, the sample is first inserted into an inner container 720. Then the lid of the inner container 720 is closed, such as by turning the threaded lid of an inner container 720 to tighten it. The inner container 720 is then wrapped, or "double contained," in plastic and secured with plastic tape. Next, foam inserts are inserted into the cup portion 622 of the secondary container 620, as shown in FIG. 7. As the foam inserts are inserted, the inner container 720 is placed into the corresponding foam insert or inserts that conform to the outside of the inner container 720. Once the inner container 720 has been placed into its surrounding foam inserts, the remaining foam inserts are placed over the top of the inner container 720. The foam inserts and inner container 720 thus fill the space within the cup portion 622 of the secondary container 620. FIG. 8 shows a cutaway view of what the inside of the secondary container 620 would look like following this step.

Next, the lid 621 of the secondary container 620 is releasably secured to the cup portion 622, such as by screwing a threaded lid 621 onto the cup portion 622. Once the lid 621 has been secured to the cup portion 622, tape 920 is placed over the lid 621 and attached to the cup portion 622 in the configuration shown in FIG. 9. The secondary container 620 is then inserted into one of the six cylindrical cutouts 422 in the custom insert 421 in the outer container 120. Ice packs 420 may then be inserted into the slots 520 of the custom insert 421 to maintain the samples at a cooler temperature. The lid 128 of the outer container 120 is then closed, and secured with the valance spanning catches 121. Following this step, the outer container 120 is ready for safely shipping the radioactive or hazardous materials. Under one embodiment, up to six liters of radioactive liquid may be shipped in a single package, not to exceed a specific gravity of 1.4, or up to 8.55 kg of solids, or any combination of solids and liquids not to exceed 8.55 kg net weight.

What is claimed is:

1. A system for safely shipping a sample of radioactive material, the system comprising:

an inner container configured to store the sample;

a secondary container to accommodate the inner container;

at least one foam insert configured to cushion the inner container by substantially filling a space between the inner container and a first inside portion of the secondary container;

an outer container having a second inside portion lined at least partially with foam to transport the secondary container; and a custom insert configured to cushion the secondary container by substantially filling a space between the secondary container and the second inside portion of the outer container.

2. The system of claim 1, wherein the inner container, the secondary container, the at least one foam insert, the custom insert, and the outer container are configured to comply with testing required, for the shipping of an $A_2$ quantity of radioactive materials, by the Department of Transportation regulations for Hazardous Materials (49 C.F.R. §§ 100–178) and the International Air Transport Association Dangerous Goods regulations (Sections 5, 6, and 10) as said regulations existed on Sep. 17, 2003.

3. The system of claim 1, wherein the inner container is made of glass.

4. The system of claim 1, wherein the at least one foam insert is made of high density polyethylene.

5. The system of claim 1, further comprising a plurality of foam inserts, and wherein the plurality of foam inserts is used to form layers to surround the inner container inside of the secondary container.

6. The system of claim 1, wherein the inner container is a first inner container, the system further comprising a second inner container, and wherein the at least one foam insert is further configured to cushion the first inner container and the second inner container by substantially filling the space between the first inner container, the second inner container, and the first inside portion.

7. A method for safely shipping a sample of radioactive material, the method comprising:

placing the sample inside an inner container;

closing a lid of the inner container;

placing at least one foam insert into a secondary container;

inserting the inner container into the at least one foam insert inside of the secondary container, wherein the at least one foam insert substantially fills a first space between the inner container and the secondary container;

closing a lid of the secondary container;

placing a custom insert into an outer container, the custom insert configured to cushion the secondary container by substantially filling a second space between the outer container and the secondary container, the custom insert further having formed therein a cutout sized to fit the secondary container;

inserting the secondary container into the cutout in the custom insert;

closing the outer container; and securing the outer container closed for shipping.

8. The method of claim 7, wherein the inner container is made of glass.

9. The method of claim 7, wherein the at least one foam insert is made of high density polyethylene.

10. The method of claim 7, wherein the at least one foam insert is a plurality of foam inserts, and wherein placing at least one foam insert into a secondary container comprises layering the plurality of foam inserts to surround the inner container inside of the secondary container.

11. The method of claim 7, wherein the inner container is a first inner container, the method further comprising inserting a second inner container into the at least one foam insert inside of the secondary container, wherein the at least one foam insert substantially fills a third space between the first inner container, the second inner container, and the secondary container.

12. The system of claim 1, wherein the inner container is configured to withstand an internal pressure of 95 kPa.

13. A kit for radioactive sample packaging, the kit comprising:

a first plurality of inner containers of a first size;

a second plurality of inner containers of a second size different from the first size, each inner container of the first and second pluralities of inner containers configured to store a radioactive sample;

a plurality of secondary containers, each of the plurality of secondary containers having an inner dimension;

a first plurality of stackable foam inserts, each of the first plurality of stackable foam inserts having at least one hole sized to fit one of the first plurality of inner containers;

a second plurality of stackable foam inserts, each of the second plurality of stackable foam inserts having at least two holes, each of the at least two holes sized to fit one of the second plurality of inner containers;

a third plurality of stackable foam inserts, each of the third plurality of stackable foam inserts having no holes formed therein;

wherein each of the plurality of secondary containers is configured to enclose a first stack and a second stack and at least one of the third plurality of stackable foam inserts, the first stack comprising at least one of the first plurality of inner containers and at least one of the first plurality of stackable foam inserts, the second stack comprising at least two of the second plurality of inner containers and at least one of the second plurality of stackable foam inserts, such that the at least one of the first plurality of stackable foam inserts, the at least one of the second plurality of stackable foam inserts, and the at least one of the third plurality of stackable foam inserts substantially fill the space between the at least one of the first plurality of inner containers, the at least two of the second plurality of inner containers, and the inner dimension, an outer container having an inside portion lined at least partially with foam to transport at least one of the plurality of secondary containers; and a custom insert configured to cushion the at least one of the plurality of secondary containers by substantially filling a space between the at least one of the plurality of secondary containers and the inside portion of the outer container.

14. The kit of claim 13, wherein each stackable foam insert of the first, second, and third pluralities of stackable foam inserts has an outer dimension corresponding to the inner dimension.

15. The kit of claim 13, wherein the first size is a container volume selected from the group consisting of: two hundred fifty milliliters, one hundred twenty-five milliliters, sixty milliliters, forty milliliters, and twenty milliliters.

16. The kit of claim 13, wherein the second size is a container volume selected from the group consisting of: two hundred fifty milliliters, one hundred twenty-five milliliters, sixty milliliters, forty milliliters, and twenty milliliters.

17. The kit of claim 13, wherein the custom insert comprises one or more slots configured to accept an ice pack.

18. The kit of claim 13, further comprising:

a third plurality of inner containers of a third size;

a fourth plurality of stackable foam inserts, each of the third plurality of stackable foam inserts having at least one hole sized to fit one of the third plurality of inner containers;

wherein each of the plurality of secondary containers is further configured to enclose the at least one of the third plurality of stackable foam inserts and one or more stacks selected from the group consisting of: the first stack, the second stack, and a third stack, wherein the third stack comprises at least one of the third plurality of inner containers and at least one of the fourth plurality of stackable foam inserts.

19. The kit of claim 18, wherein the third size is the same as the first size.

20. The kit of claim 18, wherein the third size is different from both the first size and the second size.

* * * * *